US007182628B2

(12) United States Patent
Holliday

(10) Patent No.: US 7,182,628 B2
(45) Date of Patent: Feb. 27, 2007

(54) CABLE CONNECTOR HAVING INTERCHANGEABLE COLOR BANDS

(76) Inventor: Randall A. Holliday, 4360 Augusta Dr., Broomfield, CO (US) 80020

( * ) Notice: Subject to any disclaimer, the term of this patent is extended or adjusted under 35 U.S.C. 154(b) by 0 days.

(21) Appl. No.: 11/269,284

(22) Filed: Nov. 7, 2005

(65) Prior Publication Data

US 2006/0094287 A1 May 4, 2006

Related U.S. Application Data

(63) Continuation of application No. 10/752,287, filed on Jan. 6, 2004, now Pat. No. 7,044,771, which is a continuation-in-part of application No. 10/616,273, filed on Jul. 8, 2003, now Pat. No. 6,830,479, which is a continuation-in-part of application No. 10/391,026, filed on Mar. 18, 2003, now Pat. No. 6,783,394.

(51) Int. Cl.
*H01R 3/00* (2006.01)

(52) U.S. Cl. ..... 439/491; 439/489; 174/112; 40/316

(58) Field of Classification Search ..... 439/488–491; 174/112, 114; 40/316
See application file for complete search history.

(56) References Cited

U.S. PATENT DOCUMENTS 3,069,600 A * 12/1962 Leeson, Jr. et al. ..... 361/167
4,202,351 A * 5/1980 Biche ..... 600/508
4,649,658 A * 3/1987 Sarton et al. ..... 40/316
4,656,767 A * 4/1987 Tarrant ..... 40/316
5,187,887 A * 2/1993 Mori et al. ..... 40/316

* cited by examiner

*Primary Examiner*—Truc Nguyen
(74) *Attorney, Agent, or Firm*—John E. Reilly

(57) ABSTRACT

Interchangeable identification bands are manually stretchable over coaxial cable TV connectors to identify the intended application of the connector and can be used alone or in combination with other color designations, such as, color designations for different cable sizes. The connector body has an external groove sized to receive the band, and the outer surface of the band can be of different configurations or designs, such as, flat or ribbed.

19 Claims, 9 Drawing Sheets

CABLE CONNECTOR HAVING INTERCHANGEABLE COLOR BANDS

CROSS-REFERENCE TO RELATED APPLICATIONS

This application is a continuation of patent application Ser. No. 10/752,287, filed 6 Jan. 2004, now U.S. Pat. No. 7,044,771 for CABLE CONNECTOR HAVING INTERCHANGEABLE COLOR BANDS, which is a continuation-in-part of patent applications Ser. No. 10/616,273, filed 8 Jul. 2003, now U.S. Pat. No. 6,830,479 for UNIVERSAL CRIMPING CONNECTOR by Randall A. Holliday and Ser. No. 10/391,026, filed 18 Mar. 2003, now U.S. Pat. No. 6,783,394 for UNIVERSAL MULTI-STAGE COMPRESSION CONNECTOR by Randall A. Holliday, all incorporated by reference herein.

BACKGROUND AND FIELD OF INVENTION

This invention relates to color bands for electrical connectors and more particularly relates to novel and improved color bands adapted to be interchangeably positioned on a cable connector to designate or signify the intended application of the connector and attached cable to a particular device, such as, for example, television, audio or visual electronic devices.

In the past, color bands have been placed on connectors at the time of manufacture to indicate the cable size that it can accommodate. When shipped out to the end user, typically a professional installer, can then match up a particular size cable with the connector which is color-coded to designate that particular size. The standard coaxial cable is made up of a center conductor, insulated layer surrounding the conductor, foil layer, braided layer and outer jacket. According to the specific application and frequencies being transmitted through the cable, the thickness of the braided layers is modified to provide dual-shield, tri-shield and quad-shield cables. The higher the frequency, the shorter the wave length and therefore requires more shielding to prevent leakage. Also, the braided layer may vary in thickness and density depending upon the frequencies being transmitted to a particular device.

With the advent of universal coaxial cable connectors which can accommodate more than one size or thickness cable, it has been proposed in the past to add a second color band to the connector which would indicate the intended application or use for the connector. However, a tremendous inventory problem is created for the end user in carrying a sufficient number of connectors to cover unexpected demands out in the field for a given connector size, type and frequency. It is therefore desirable to provide a method and means by which the end user can identify the specific application only after installing a particular size and frequency of cable into the connector for a specific application. A typical color code in which each application is identified or signified by a different color is as follows:

TABLE I

| | |
|---|---|
| Audio positive and negative connectors (sound equipment, etc.) | a combination of a red band for one connector and either a black or white band for the other connector |
| Video components requiring three connectors (camera equipment, etc.) | a combination of one red band for one connector, a blue band for second connector and green band for third connector |

TABLE I-continued

| | |
|---|---|
| Television, VCRs, etc. requiring three connectors | yellow band for composite video connector white band for composite audio connector red band for composite audio connector |

However, there is a continuing need for a marker or band that can be placed on the connector in the field after the cable has been installed or connected to the connector.

SUMMARY OF THE INVENTION

It is therefore an object of the present invention to provide for a novel and improved method and means for coding a connector according to its intended application.

It is another object of the present invention to provide for a novel and improved method and means for coding a connector according to its intended application after a cable has been attached to the connector.

It is a further object of the present invention to provide for a novel and improved color band for releasable connection to an external surface of a connector for a coaxial cable.

A still further object of the present invention is to provide for a novel and improved method and means for interchangeably connecting different colored bands to a coaxial cable connector after the cable has been secured to the connector and wherein the invention is particularly conformable for use with crimp-type cable connectors.

It is another object of the present invention to provide for a novel and improved color band which is consistently located in the same position on each connector and is easily recognizable in identifying the intended application of the connector to which it is attached.

In accordance with the present invention, there has been devised for use with a cable connector of the type having a hollow cylindrical body provided with a fastening member at one end for connection to an electronic component and a sleeve at the opposite end to receive an electrical cable for connection to the body whereby to complete the connection to the selected electronic component, the improvement comprising a resilient band of an external appearance signifying the intended application of the connector to the electrical component, the band being attachable to the body after the cable is connected to the body. Preferably the band is in the form of an endless ring which is manually stretchable over the body and releasable to contract into close-fitting engagement with the body. The body is provided with an external groove sized to receive the band so that the outer surface of the band is either flush with the external surface of the body or may be provided with circumferentially extending ribs to facilitate gripping of the connector. To this end, a plurality of resilient bands are supplied to the installer in the field along with one or more connectors for use with different sized cables and as a kit to enable the installer to properly match the band and install onto a connector for a particular component.

The above and other objects, advantages and features of the present invention will become more readily appreciated and understood from a consideration of the following detailed description of preferred and modified forms of the present invention when taken together with the accompanying drawings in which:

DETAILED DESCRIPTION OF FIRST EMBODIMENT

Figure 1:
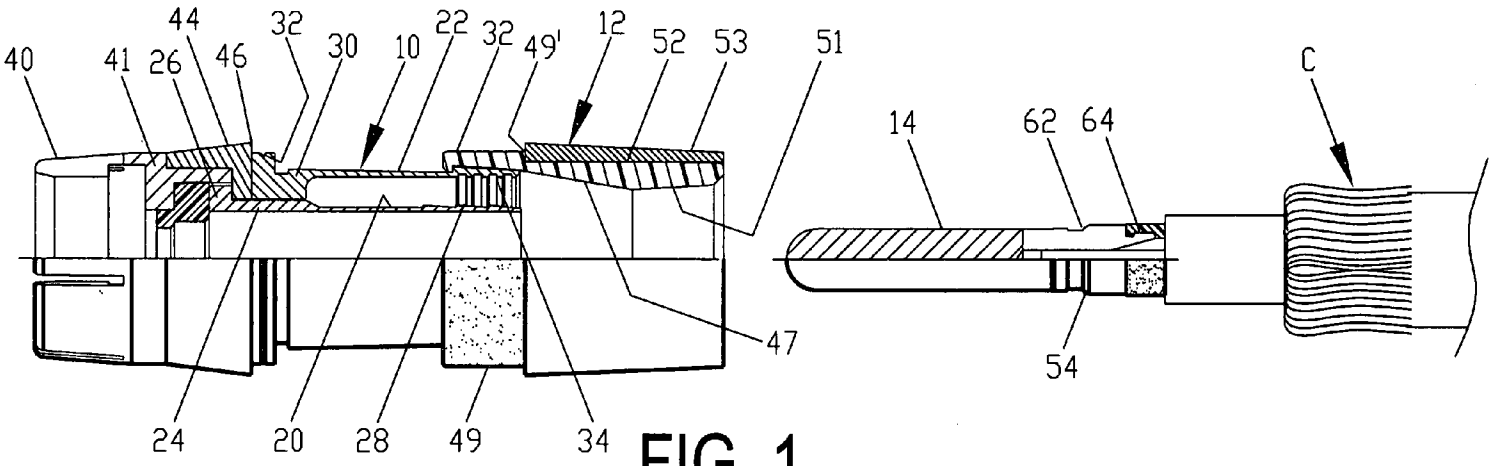
FIG. 1 is an exploded view partially in section of a coaxial cable connector in an open position prior to installation of a cable and starter guide.
Figure 2:
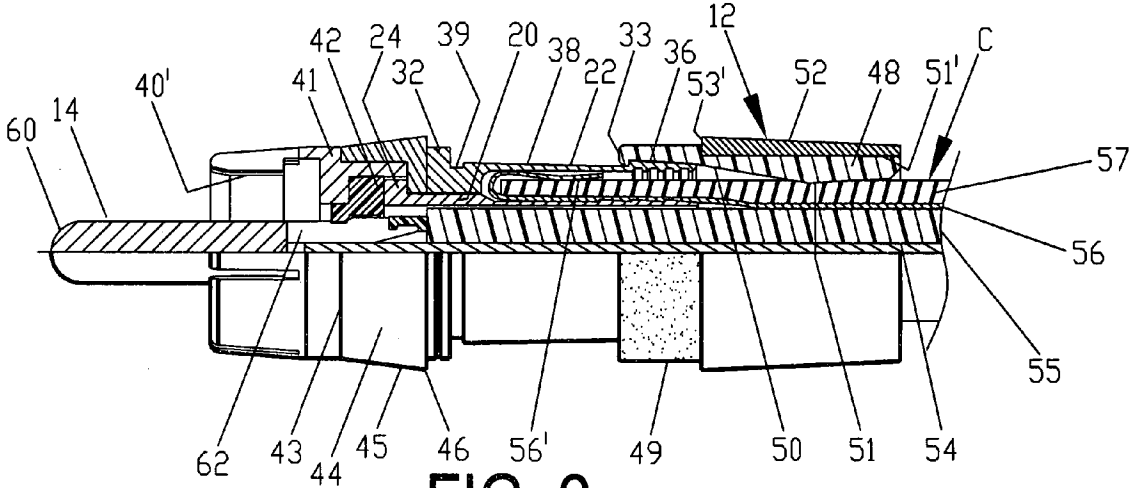
FIG. 2 is a view similar to FIG. 1 but illustrating insertion of the cable and starter guide into the connector.
Figure 3:
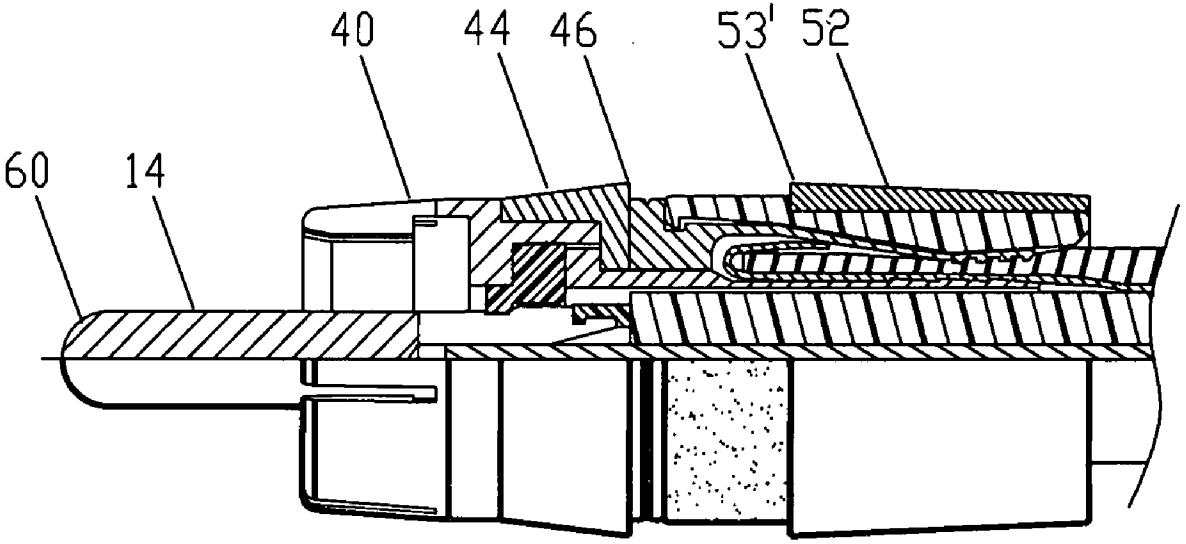
FIG. 3 is another view similar to FIG. 1 but illustrating the connector in the crimped or closed position.

Referring to the drawings, FIGS. 1 to 3 illustrate a coaxial cable connector 10 of the type commonly referred to as an RCA connector having a crimping ring 12 at one end through which an installation guide or extension tip 14 is inserted to facilitate attachment of a standard coaxial cable C to the connector 10. The connector 10 is broadly comprised of inner sleeve 20 and outer sleeve 22 in concentrically spaced relation to one another, the inner sleeve 20 verging into a cylindrical body 24 which terminates in an external shoulder 26. The sleeve 20 has a series of external serrations 28 angled in a direction away from the entrance end of the connector 10.

In turn, the outer sleeve 22 verges into a cylindrical body 30 and an external shoulder 33 at one end opposite to a series of internal ribs or endless rings 34 in facing relation to the serrations 28 on the inner sleeve 20. The sleeve 22 is made up of a first wall section 36 which tapers rearwardly away from the shoulder 33 and a second wall section 38 which tapers rearwardly away from a notch 39 and terminates at the shoulder 33.

A ferrule 40 includes an annular body 41 which bears against a limit stop 42 of annular configuration which has a radially inwardly projecting rib 43, the limit stop being interposed between the body 41 of the ferrule 40 and the body 24 of the inner sleeve 20. The ferrule 40 has circumferentially spaced, longitudinal slots 40' to facilitate attachment to a conventional post or terminal, not shown. A keeper 44 is interposed between the body 41 and body 30, the keeper having an external wall surface 45 which tapers forwardly from an external shoulder 46 for a purpose to be described.

The crimping ring 12 is adapted to be preassembled on the connector 10 and includes an annular body 48 preferably composed of a low friction material having limited compressibility, such as, DELRIN® or a similar hardened plastic material. One end portion 49 of the body 48 is relatively thin-walled and tapered rearwardly with an internal surface 47 complementary to the tapered wall section of the outer sleeve 22 so that the crimping ring can be press-fit onto the end of the connector 10. The body 48 thickens gradually away from the end portion 49 to define another tapered internal surface 50 leading into outwardly divergent inner surface 51. An exterior surface of the body 48 is undercut or recessed from a point just forwardly of the end portion 49 to receive a reinforcing band 52 which is preferably composed of a brass material. The reinforcing band 52 fits snugly over the body 48 and has an external tapered surface portion 53 extending rearwardly from an external shoulder 49' of the end portion 49. The cable C must therefore advance along the interior surface of the crimping ring 12 prior to insertion of the exposed portion of the cable into the annular space between the sleeves 20 and 22. In this relation, the cable C is of conventional construction and broadly comprised of an inner conductor pin 54 surrounded by a dielectric insulator 55, an outer braided conductor 56 and an outer jacket 57. Prior to inserting the end of the cable C through the crimping ring 12, the cable end is prepared by removing a first length of the outer jacket 57 and braided conductor 56, and a shorter length of the dielectric insulator 55 is removed to expose an end of the conductor pin 54 as well as a thin layer of foil surrounding the pin 54. Further, the braided conductor 56 is peeled away from the insulator 55 and doubled over a forward end of the jacket 57 as at 56'.

In accordance with the present invention, the installation guide 14 operates as a means for establishing precise alignment of the cable C as it is inserted into the end connector 10. In the form shown in FIGS. 1 to 3, the guide 14 takes the form of an elongated cylindrical rod of a diameter substantially equal to the inner diameter of the inner sleeve 20 so as to be capable of fitting snugly into the central opening defined by the inner sleeve 20 but axially slidable therethrough under a positive pressure. Moreover, the guide 14 is of a length approximating the length of the crimping ring 12 and has a rounded end 60 to facilitate partial insertion of the guide 14 into the central opening, the opposite end 62 of the guide being positioned in proximity to the entrance end of the crimping ring 12. The end 62 has a tapered bore 64 of generally conical configuration for the purpose of receiving the conductive pin 54 of the cable C, as shown in FIG. 1. Under advancement of the cable and guide, as shown in FIG. 2, the doubled over portion 58 of the cable is aligned with the annular space 21 between the sleeves 20 and 22 and will undergo separation from the inner dielectric 55 as it is expanded into the space. The male end or pin 54 of the cable C is centered by the guide until the doubled over portion 56' of the cable C is inserted into the space 21 and the external groove 15 moves into alignment with the inwardly projecting rib 43 with the leading end of the guide 14 projecting through the leading end of the ferrule 40.

Figure 3A:
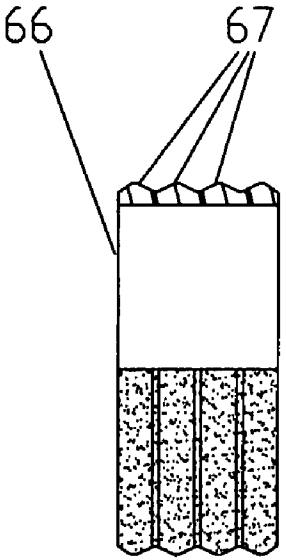
FIG. 3A is a view partially in section of one form of color band prior to mounting on the connector of FIG. 3.

As illustrated in FIGS. 1 and 2, the crimping ring 12 is dyed to a specific color which represents the particular size cable C to be installed in the connector, and the end portion 51' of the crimping ring 12 forwardly of the reinforcing band 52 will remain exposed even after the crimping ring has been preassembled onto the connector 10. Similarly, the trailing end 49 of the crimping ring 12 will be at least partially exposed to designate the color and accordingly the size of cable C installed. In coaxial cable connectors, such as, the connector 10 which are conformable for use in different applications, a color code has been established to identify or signify each application with a different color as noted earlier. As a practical matter, however, the particular application may not be determined until the connector 10 and cable C have been assembled in the field. Accordingly, to this end, a complete set of different colored bands 66 is furnished with each connector, each band being correspondingly sized to fit into the groove established between the shoulders 46 and 53' of the reinforcing band 52 and the keeper 44. Moreover, to facilitate secure mounting of the band 66 in the groove, each band is composed of an elastic material which can be expanded to slide over the connector body 48 from either end but typically would be advanced over the leading end of the connector after the cable C has been preassembled. When a band 66 is aligned with the groove, it can be released to contract into position between the shoulders 46 and 53'. In the specific form of band illustrated in FIG. 3A, the external surface of the band is provided with a series of circumferentially extending ribs 67 so as to facilitate gripping of the band when installed. Each band 66 is of a width corresponding to the groove formed between the shoulders 46 and 53' and of a thickness substantially corresponding to the depth of the groove.

Figure 6:
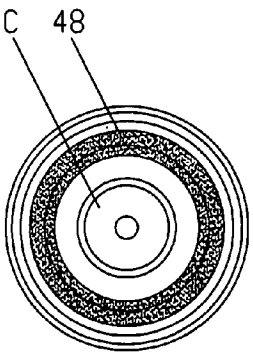
FIG. 6 is another end view from a trailing end of the connector shown in FIGS. 1 to 4.
Figure 4:
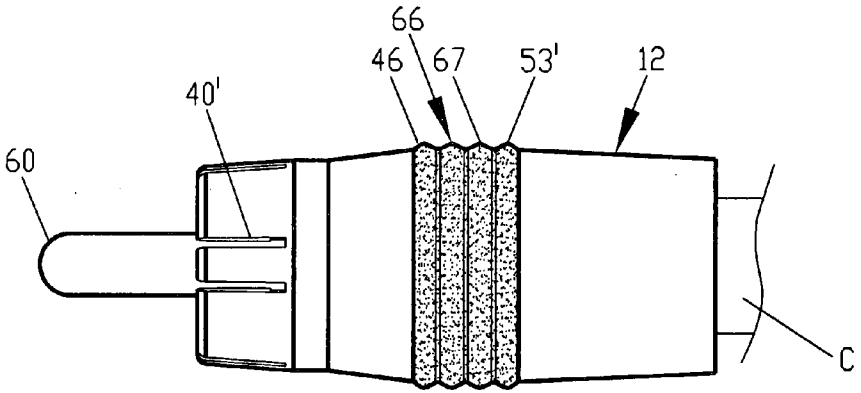
FIG. 4 is an elevational view in full of the connector shown in FIGS. 1 to 3 in the closed position with a color band mounted thereon.
Figure 5:
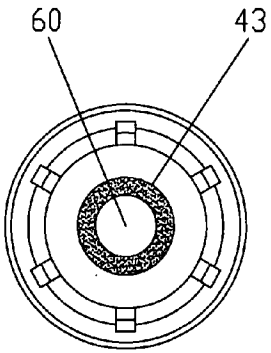
FIG. 5 is an end view from a leading end of the connector shown in FIGS. 1 to 4.

FIGS. 4, 5 and 6 illustrate in full the form of connector shown in FIGS. 1 to 3 after the band 66 has been positioned in the groove between the shoulders 46 and 53'. The band is color coded or dyed to be of a particular color in accordance with the color code as described in Table I. In addition, as illustrated in FIG. 6, the body 48 of the crimping ring 12 is color coded according to the size of cable inserted into the connector.

Figure 4A:
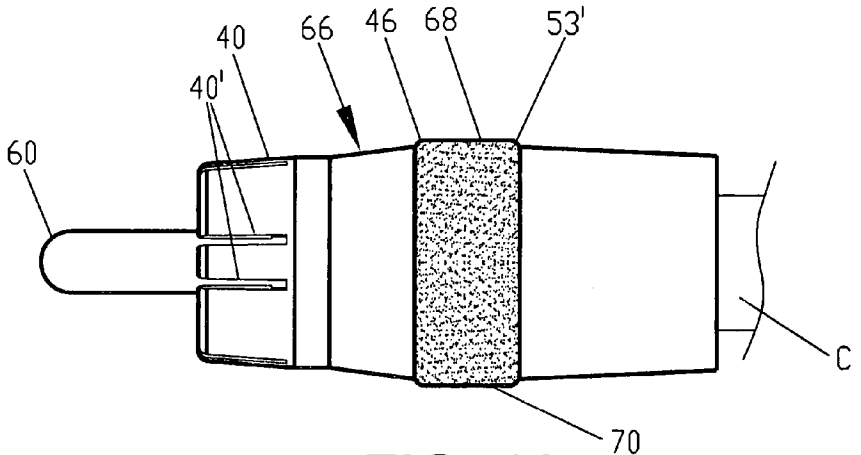
FIG. 4A is an elevational view of the cable connector of FIG. 4 having a modified form of color band.

FIG. 4A illustrates in full the connector 10 of FIGS. 1 to 3 in the closed or crimped position but with a modified form of color band 68. The color band 68 is identical in all respects to the color band 66 but has an outer smooth surface 70 in place of the ribbed surface 67. The end views of the form of connector shown in FIG. 4A would correspond to those illustrated in FIGS. 5 and 6.

DETAILED DESCRIPTION OF ALTERNATE FORMS OF INVENTION

Figure 9:
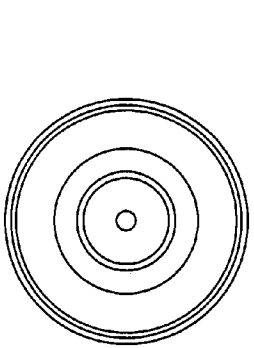
FIG. 9 is an opposite end view of the trailing end of the connector shown in FIG. 7.
Figure 7:
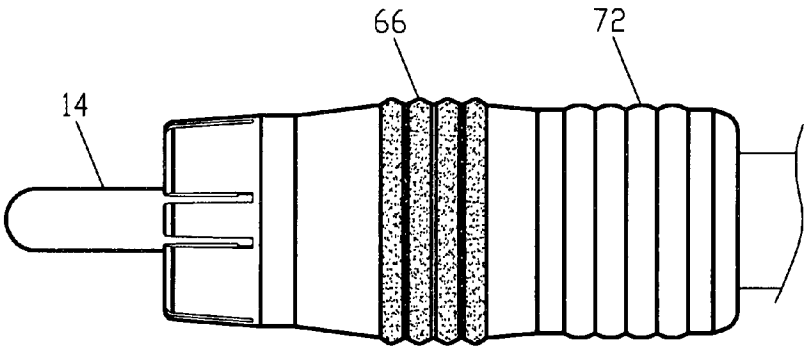
FIG. 7 is an elevational view in full of another form of connector shown in the closed position with a color band mounted thereon.
Figure 8:
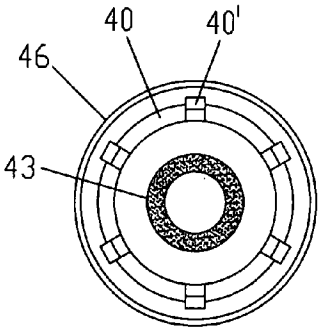
FIG. 8 is an end view of the connector shown in FIG. 7 from the leading end thereof.
Figure 7B:
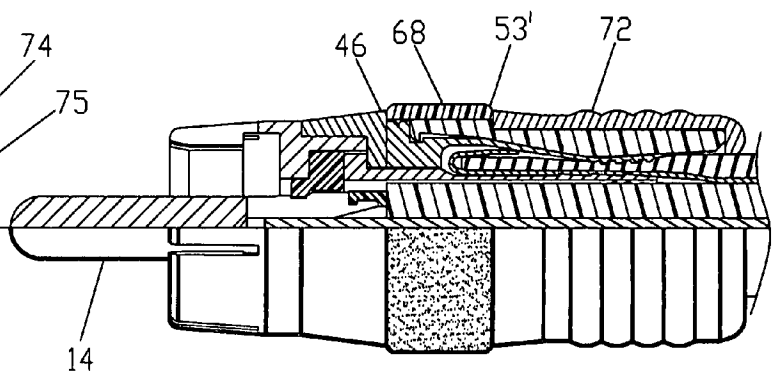
FIG. 7B is an assembled view partially in section of the connector of FIG. 7A in the closed position with a modified color band mounted thereon.
Figure 7A:
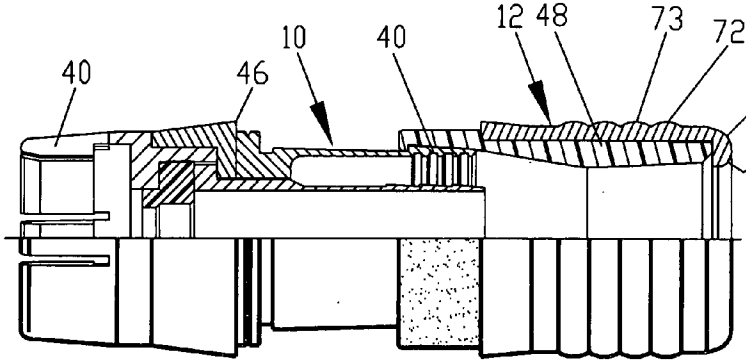
FIG. 7A is an exploded view partially in section of the connector shown in FIG. 7.
Figure 7A:
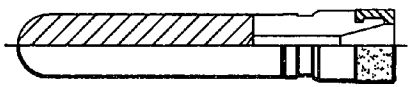

FIGS. 7, 8 and 9 illustrate the same basic form of connector as shown in FIGS. 1 to 6 and like parts are correspondingly enumerated. FIGS. 7A and 7B are sectional views of the connector of FIGS. 7 to 9, FIG. 7A illustrating the connector in an open position prior to installation of a color band 66, and FIG. 7B illustrating the connector in the closed position and with a color band 66 installed in the groove between the shoulders 46 and 53'. The notable distinction is that the crimping ring 12 has an outer liner 72 with axially spaced, circumferentially extending ribs 73 in outer surrounding relation to the annular body 48 of the crimping ring 12. In addition, the liner 72 has a radially inwardly projecting end portion 74 which covers the end of the body 48 and terminates in an inner rounded surface 75 of substantially the same inner diameter as the trailing end of the body 48 so as not to interfere with the insertion of the cable into the connector as illustrated in FIG. 7B. As in FIGS. 1 to 6, the reinforcing band or liner 72 is composed of a metal material, such as, brass and the external ribbed configuration of the band 66 as well as the liner 72 lend a distinctive aesthetic appearance to the connector. The installation guide 14 is mounted on the end of the cable C to facilitate its insertion into the connector in the same manner as described with reference to FIGS. 1 to 4.

Figure 12:
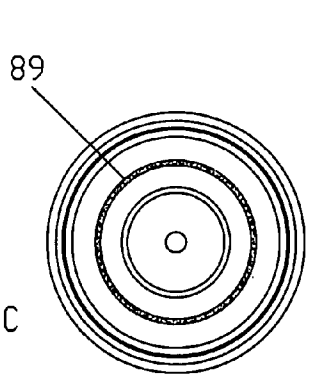
FIG. 12 is another end view from a trailing end of the connector shown in FIG. 10.
Figure 10:
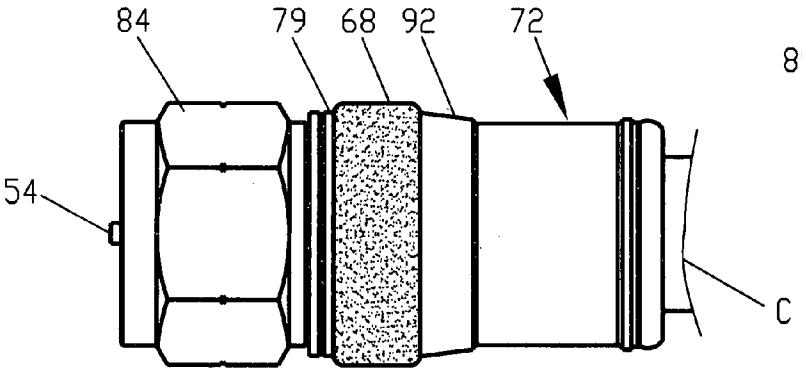
FIG. 10 is an elevational view in full of still another form of cable connector shown in the closed position and illustrating a color band mounted thereon.
Figure 11:
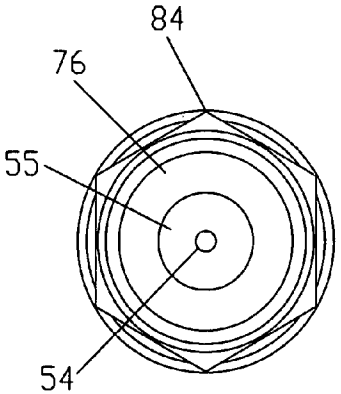
FIG. 11 is an end view from a leading end of the connector shown in FIG. 10.
Figure 10B:
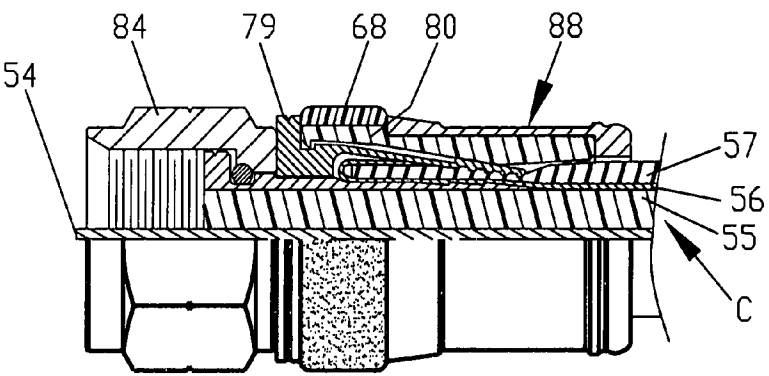
FIG. 10B is an assembled view partially in section of the connector of FIG. 10A in the closed position with a modified color band mounted thereon.
Figure 10A:
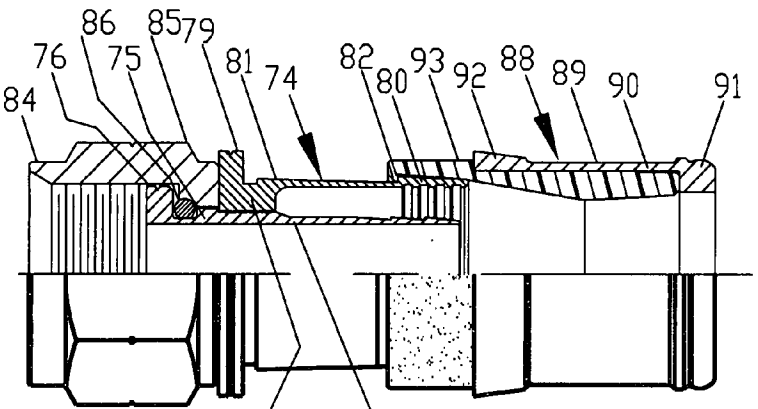
FIG. 10A is a view partially in section and in the open position of the connector shown in FIG. 10.

There is illustrated in FIGS. 10 to 12 another form of coaxial cable TV connector 72 which is shorter than the RCA connector 10 of FIGS. 1 to 9 and does not require an extension tip, such as, the extension tip 14 of FIGS. 1 to 9 for the conductor pin 54 of the cable C. The connector 72 per se is comprised of the same basic elements as the connector 10 and, as best seen from FIGS. 10A and 10B, is broadly comprised of concentrically spaced inner sleeve 73 and outer sleeve 74, the inner sleeve 73 verging into a cylindrical body 75 which terminates in an external shoulder 76. The outer sleeve 74 verges into a cylindrical body 78 having an external shoulder 79. The sleeve 74 is made up of tapered wall sections 80 and 81 with a shoulder 82 therebetween as in the connector 10.

A nut 84 is internally threaded and terminates in an internal shoulder 85 interposed between the shoulders 76 and 79 of the sleeves 73 and 74. An O-ring seal 86 is captured between the shoulder 85 and shoulder 76, and the nut 84 is free to rotate independently of the sleeves 73 and 74, for example, when being fastened to a post or terminal, not shown.

A crimping ring 88 is made up of an annular body 89 which corresponds to the annular body 48 of FIGS. 1 to 9 and is undercut on its outer surface to receive a reinforcing band 90 composed of a metal material, such as, brass. The greater length of the reinforcing band 90 is of uniform diameter and terminates in a rounded end portion 91 at the entrance end of the connector 74 and an opposite, thickened end portion 92 which abuts an externally circumferentially extending shoulder 93 on the body 89. The cable C is of standard construction and the parts are therefore enumerated to correspond to those of FIGS. 1 to 9. Owing to the shorter dimension of the connector 74, the cable C can be inserted through the connector 72 without the aid of an extension tip 14, and the doubled over portion of the braided layer 56 along with the jacket 57 will move into the concentric space between the inner and outer sleeves 73 and 74, as best seen from FIG. 10B. The dielectric layer 55 is inserted through the inner sleeve 73 with its leading end substantially flush with that of the shoulder 76 and the conductor pin 54 projecting through the nut 84.

Once the cable is seated or installed as described, a standard crimping tool, such as, that set forth and described in U.S. Pat. No. 6,089,913 may be employed to advance the crimping ring 88 along the outer sleeve 74 to impart radial compression to the outer sleeve 74 and force it into secure crimping engagement with the outer jacket 57 and layer 56, as illustrated in FIG. 10B. An elastic color band 68 corresponding to that of FIG. 4A is shown after insertion into the groove between the shoulders 79 and leading edge of the end portion 92. The inner body 89 of the crimping ring 88 may or may not be color coded to designate the cable size to be installed in the connector 72 but is illustrated as being color coded in FIGS. 10A and 12.

It will be readily apparent that either type of color band 66 or 68 of FIGS. 1 to 9 may be utilized in the connector 74. In addition, once the connector is assembled and crimped into the closed position as shown in FIG. 10B, the end of the body 89 will be visible, as illustrated in FIG. 12.

Figure 15:
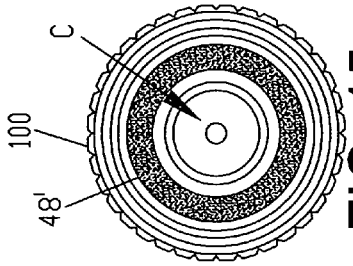
FIG. 15 is an opposite end view from a trailing end of the connector shown in FIG. 13.
Figure 13:
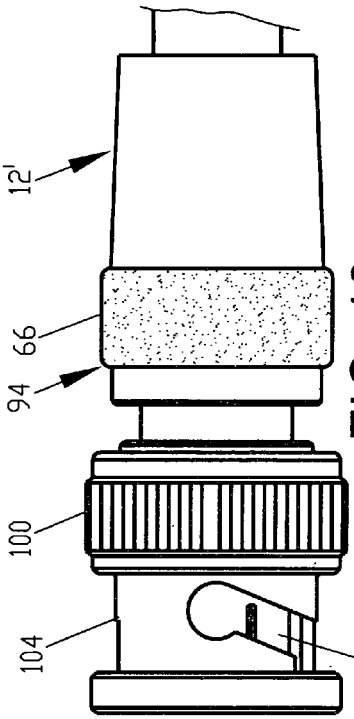
FIG. 13 is an elevational view in full of another alternate form of cable connector in the closed position illustrating a modified color band mounted thereon.
Figure 14:
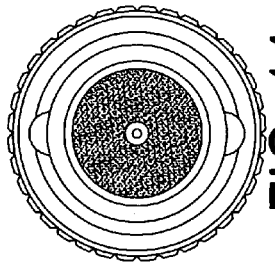
FIG. 14 is an end view of the connector shown in FIG. 13 from a leading end of the connector.

A BNC connector 94 having an elastic color band 66 is illustrated in FIGS. 13 to 15. The BNC type of connector is similar to the RCA connector of FIGS. 1 to 3 with its increase in overall length and therefore utilizes an extension pin 96 at the end of a socket 97 which receives the conductor pin 54 of the cable C. The extension pin 96 is centrally supported by an annular support 98 within ferrule 100. The ferrule 100 is mounted on a cylindrical casing 102 which is mounted on inner sleeve 20' and in abutting relation to outer concentric sleeves 22'. A barrel portion 104 forms an axial extension of the ferrule 100 and is provided with one or more angular bayonet slots 106. Post-engaging prongs 108 on a cylindrical liner 109 are concentrically spaced within the barrel 104 to facilitate attachment of the connector to a post or terminal in a well-known manner. In this relation, like parts to those of the connector 10 of FIGS. 1 to 9 are correspondingly enumerated with prime numerals including the crimping ring 12', sleeves 20' and 22'.

Figure 13A:
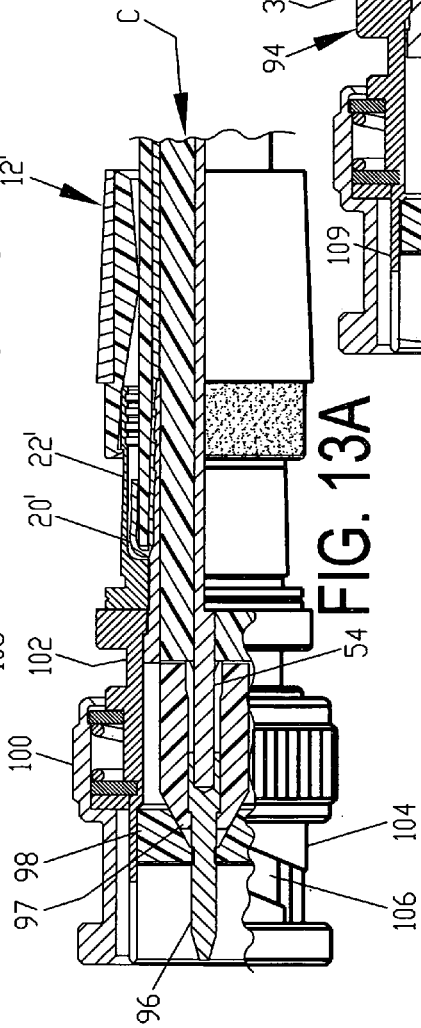
FIG. 13A is a view partially in section of the connector shown in FIG. 13 in the open position prior to mounting of the color band thereon.
Figure 13B:
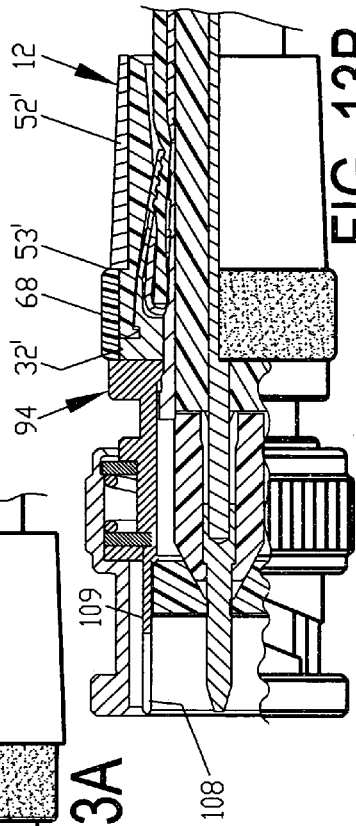
FIG. 13B is a view partially in section of the connector of FIG. 13A in the closed position with a color band mounted thereon.

FIG. 13B illustrates the connector 94 in the closed position with a color band 68 inserted in the groove formed between external shoulder 32' and shoulder 53' of the reinforcing band 52' of the crimping ring 12'.

Figure 18:
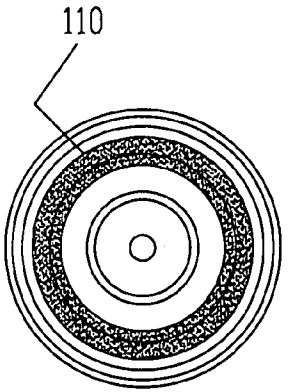
FIG. 18 is an opposite end view from a trailing end of the connector shown in FIG. 16.
Figure 16:
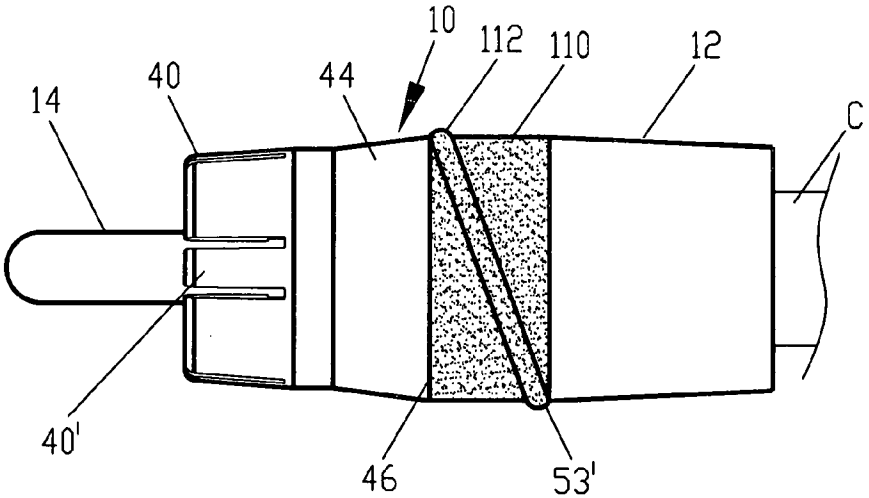
FIG. 16 is an elevational view of a cable connector in the closed position with another modified form of color band mounted thereon.
Figure 16B:
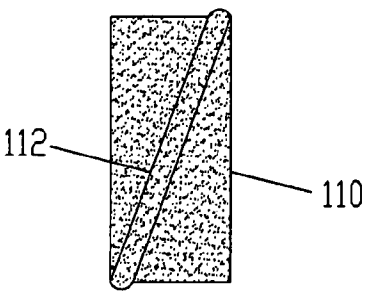
FIG. 16B is an end view of the color band of FIG. 16.
Figure 16A:
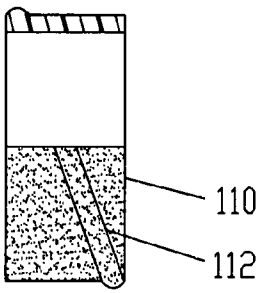
FIG. 16A is a view partially in section of the color band prior to mounting on the connector of FIG. 16.
Figure 17:
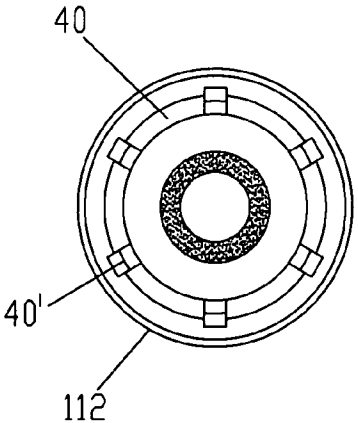
FIG. 17 is an end view of the connector shown in FIG. 16 from a leading end thereof.
Figure 21:
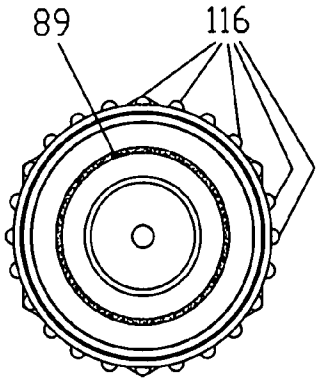
FIG. 21 is an opposite end view from a trailing end of the connector shown in FIG. 19.
Figure 20:
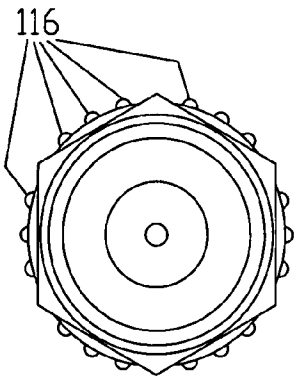
FIG. 20 is an end view of the connector shown in FIG. 19 from a leading end thereof.

FIGS. 16 to 18 illustrate another form of color band 110 mounted on an RCA connector 10 which corresponds to that illustrated in FIGS. 1 to 3. Individual parts of the connector 10 which are visible are correspondingly enumerated to those of FIGS. 1 to 3 and is broadly comprised of a crimping ring 12 at one end through which an extension tip 14 extends to facilitate attachment of a cable C. The color band 110 is furnished as one of a set of different color bands and wherein each band is correspondingly sized to fit into the groove between shoulders 46 and 53' on the connector. Furthermore, the band 110 is composed of an elastic material to permit expansion over the crimping ring 12 at one end or the keeper 44 at the opposite end and into alignment with the groove, not shown, but corresponding to the groove 49 of the connector 10 in FIGS. 1 to 3. As best seen from the sectional view of FIG. 16A of a band 110 prior to its mounting, the band is of generally rectangular cross-section corresponding to the depth and width of the groove between the shoulders 46 and 53' and an external rib 112 extends in a diagonal direction around the external surface of the band 110.

Figure 19:
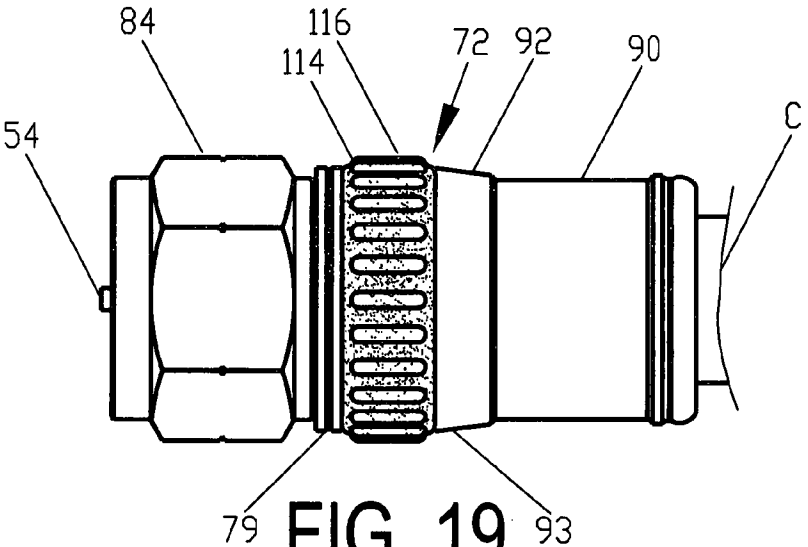
FIG. 19 is an elevational view of another form of connector shown in the closed position and illustrating another form of color band mounted thereon.
Figure 19B:
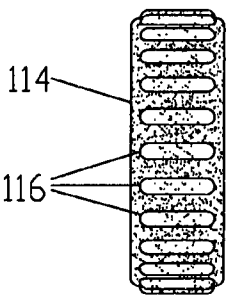
FIG. 19B is an end view of the color band of FIG. 19.
Figure 19A:
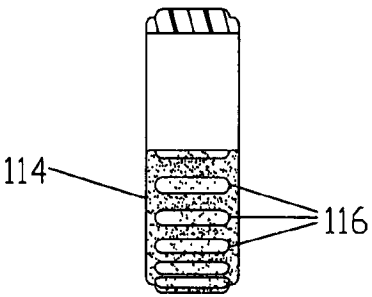
FIG. 19A is a view partially in section of the color band prior to mounting on the connector of FIG. 19.
Figure 24:
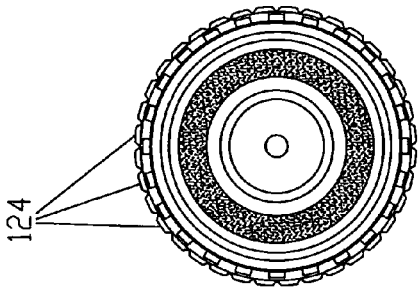
FIG. 24 is an opposite end view of the connector shown in FIG. 22 taken from the trailing end thereof.

FIGS. 19 to 21, 19A and 19B illustrate in full another form of color band 114 mounted on a coaxial cable TV connector 72 of the type illustrated in FIGS. 10 to 12 and therefore correspondingly enumerated to the connector 72 of FIGS. 10 to 12. Broadly, an internally threaded nut 84 is mounted at one end of the connector and a crimping ring is mounted at the opposite end having an external reinforcing band 90 which terminates in a thickened portion 92 having an external shoulder 93 in facing relation to a shoulder 79 in proximity to one end of the nut 84. As shown in FIGS. 19A and 19B, the elastic band 114 includes a main wall of generally rectangular cross-section of a depth and width to fit into a groove formed between the shoulders 93 and 79, and a plurality of external ribs 116 are disposed in equally spaced circumferential relation around the external surface of the band. Once again, the connector 72 is shorter than the RCA connector 10 and does not require an extension tip for the conductor pin 54 of the cable C. The connector 72 is illustrated in the closed position in FIG. 19 after insertion of the color band 114 into the groove between the shoulders 79 and 93. An inner body 89 of the crimping ring 88 may or may not be color-coded to designate the cable size to be installed in the connector 72 but is illustrated as being color-coded in FIG. 21 to indicate the cable size; whereas the color band 114 is dyed to signify the intended application for the connector.

Figure 22:
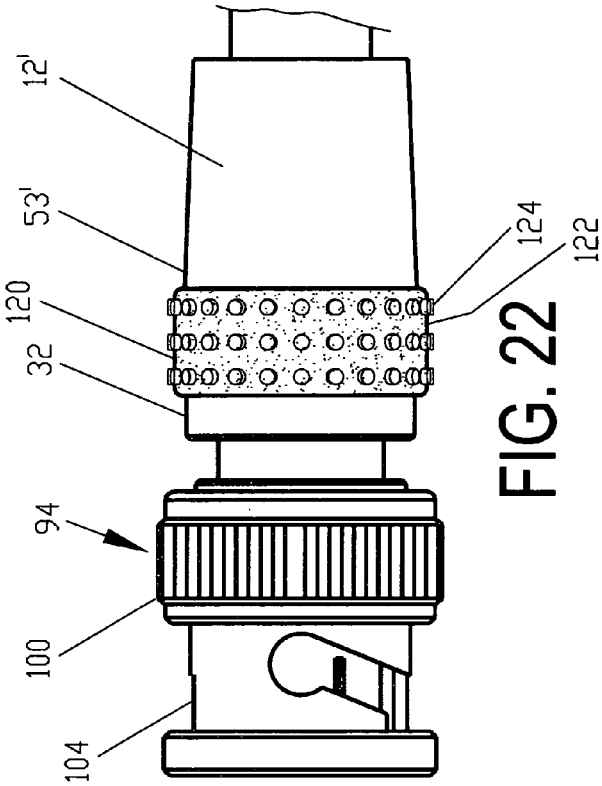
FIG. 22 is an elevational view in full of a cable connector in the closed position illustrating another modified form of color band mounted thereon.
Figure 22B:
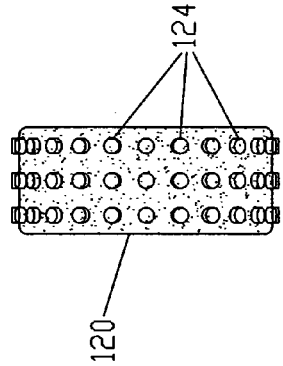
FIG. 22B is an opposite side view of the color band of FIG. 22.
Figure 22A:
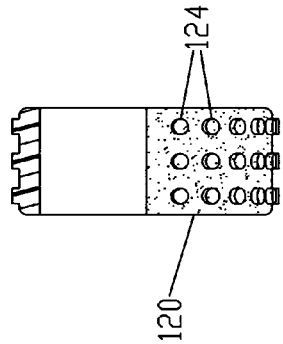
FIG. 22A is a view partially in section of the color band prior to mounting on the connector of FIG. 22.
Figure 23:
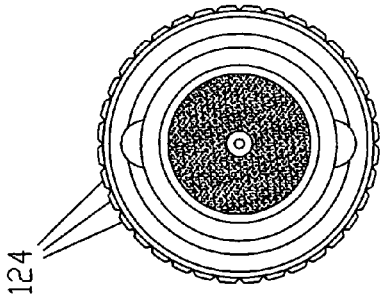
FIG. 23 is an end view of a connector shown in FIG. 22 from a leading end thereof.

FIGS. 22 to 24, 22A and 22B illustrate another form of color band 120 adapted for mounting on a BNA connector 94 corresponding to that illustrated in FIGS. 13 to 15. Broadly, the external parts of the connector shown in FIGS. 22 to 24 include the ferrule 100, barrel portion 104 at one end of the ferrule 100, and a crimping ring 12' at the opposite end. The color band 120 is adapted for mounting in a groove formed between confronting shoulders 32 and 53' when the connector is in its closed or crimped position as shown in FIG. 22. As best seen from FIGS. 22A and 22B, the color band has a generally rectangular cross-section of a depth and width to fit snugly between the shoulders 32 and 53' with its external surface 122 projecting slightly beyond the external surfaces of the crimping ring 12' and external shoulder 32, and a plurality of nodules 124 are arranged in circumferential rows and in equally spaced circumferential relation to one another in each row across the entire width of the external surface 122.

The foregoing description of different embodiments of the present invention serve to highlight the versatility of the color bands 66 and 68, 110, 114 and 120 for mounting on different connectors. Similarly, although the band-receiving grooves formed on the external surfaces of the connectors are not absolutely essential, they assist in protecting each band when positioned on a connector. The groove also results in a low profile connector and assures that the band is consistently seated in the same location on each connector so as to be readily recognized by the installer in the field as representing a specific application. Accordingly, in establishing a standard for the industry, it is desirable not only that the bands be of a specific color and size but be located in the same position on each connector and be readily discernible from other color codes, such as, the crimping ring color code used to designate a specific size of cable.

It is therefore to be understood that while preferred forms of invention are herein set forth and described, the above and other modifications may be made therein without departing from the spirit and scope of the invention as defined by the appended claims and reasonable equivalents thereof.

I claim:

1. In a cable connector having a hollow cylindrical body provided with a fastening member at one end for connection to an electronic component and an opposite end for insertion of a selected electrical cable for electrical connection to said electronic component, the improvement comprising:

a plurality of markers of different distinct appearances, each of said distinct appearances signifying the intended application of said connector to said component for the selected cable, at least one of said markers of a selected one of said distinct appearances being attachable to said body in the field after the selected cable is connected to said body and preliminary to connection of said fastening member to said electronic component.

2. In a connector according to claim 1 wherein each said marker is in the form of an endless ring.

3. In a connector according to claim 2 wherein each said marker is manually stretchable over said body and releasable to contract into close-fitting engagement with said body.

4. In a connector according to claim 1 wherein each said marker is a resilient band of a normal diameter less than the diameter of said body and is manually stretchable over said body and releasable into snug-fitting engagement with said body.

5. In a connector according to claim 4 wherein said band has external circumferentially extending ribs.

6. In a connector according to claim 5 wherein said ribs have outer rounded external surfaces.

7. In a connector according to claim 4 wherein said body includes an external groove dimensioned to receive said band.

8. In a connector according to claim 1 wherein said connector is conformable for connection to different sized cables.

9. In a cable connector kit for assembly in the field having a hollow cylindrical body provided with a fastening member at one end for connection to one of several electronic devices and having a sleeve at an opposite end into which a selected electrical cable is insertable for electrical connection to a selected of said devices, the improvement comprising:

a plurality of resilient bands including external portions of different colors, each said color signifying a different one of said devices to which said connector and the selected electrical cable are to be connected, at least one or more of said bands being interchangeably connectable to an external surface of said body in the field and being secured to said body after the selected cable is connected to said sleeve.

10. In a connector according to claim 9 wherein each said band is in the form of an endless ring manually stretchable over said body and releasable to contract into close-fitting engagement with an external groove in said body.

11. In a connector according to claim 9 wherein each said band is of a diameter less than the diameter of said body and is manually stretchable over said body and releasable into snug-fitting engagement with an external surface of said body.

12. In a connector according to claim 9 wherein said bands each have outer rounded external surfaces.

13. In a connector according to claim 9 wherein said body includes an external groove dimensioned to receive each of said bands.

14. In a connector according to claim 9 wherein said connector is conformable for connection of different sized cables.

15. In a connector according to claim 14 wherein said connector includes a second band signifying the size of cable insertable into said body.

16. In a cable connector kit for use in the field, the combination comprising:

a universal connector having a hollow cylindrical body provided with a fastening member at one end for interchangeable connection to one of a plurality of electronic devices, each of said devices having a different application, a sleeve at an opposite end into which one of a plurality of coaxial cables is insertable in the field for electrical connection to a selected of said devices, said connector being externally marked to designate the cable size to be inserted therein, an external shoulder between one end of said sleeve and said fastening member, and a crimping member adapted to be advanced over said sleeve to compress said sleeve into crimping engagement with said cable; and a plurality of resilient bands of different colors, each said color signifying said selected of said devices to which said connector is to be connected, each said band being in the form of an endless resilient ring manually stretchable over said connector and releasable to contract into an external groove between said crimping ring and said external shoulder after said sleeve is compressed into crimping engagement with said cable in the field and preliminary to connection of said fastening member to said electronic component.

17. In a cable connector according to claim 16 wherein said connector is conformable for connection of different sized cables thereto.

18. In a cable connector according to claim 16 wherein said connector includes a second band of a color representing the size of cable insertable into said sleeve.

19. In a cable connector according to claim 18 wherein said crimping ring terminates in a second external shoulder in axially spaced facing relation to said first external shoulder.

* * * * *